US010285441B2

(12) United States Patent
Poss

(10) Patent No.: US 10,285,441 B2
(45) Date of Patent: May 14, 2019

(54) LIPID CONCENTRATE VAPORIZING APPARATUS AND METHOD

(71) Applicant: Kevin Thomas Poss, Willits, CA (US)

(72) Inventor: Kevin Thomas Poss, Willits, CA (US)

( * ) Notice: Subject to any disclaimer, the term of this patent is extended or adjusted under 35 U.S.C. 154(b) by 0 days.

(21) Appl. No.: 15/629,964

(22) Filed: Jun. 22, 2017

(65) Prior Publication Data

US 2018/0368470 A1 Dec. 27, 2018

(51) Int. Cl.
*A24F 47/00* (2006.01)
*A24F 1/32* (2006.01)

(52) U.S. Cl.
CPC ..... *A24F 47/006* (2013.01); *A24F 1/32* (2013.01)

(58) Field of Classification Search
None
See application file for complete search history.

(56) References Cited

U.S. PATENT DOCUMENTS 8,955,521 B1 * 2/2015 Hanson ..... A24F 1/00 131/191

OTHER PUBLICATIONS

"Nectar Collector Honey Badger" (https://nectarcollector.org/shop/nectar-collector-honey-badger/). (Year: 2015).*

* cited by examiner

*Primary Examiner* — Michael J Felton
*Assistant Examiner* — Katherine A Will
(74) *Attorney, Agent, or Firm* — Lamon Patent Services; Cynthia S. Lamon

(57) ABSTRACT

A novel lipid concentrate vaporizer apparatus comprises an elongate hollow tubular upper portion including an opening at one end, a lower portion including a bulbous closed second end, a solid stem extending away from the bulbous portion and a solid heating tip formed at the end of the stem. The upper and lower portions share a wall thickness and the bulbous end includes one or more air intake holes formed at a position above the stem and when the tip is heated to a temperature to vaporize and not combust the lipid concentrate contained in a vessel having a specific shape, the tip makes contact with the lipid concentrate and the resulting vapor is drawn into the upper portion via the holes by a user creating suction and inhaling at the opening at the one end.

20 Claims, 14 Drawing Sheets

LIPID CONCENTRATE VAPORIZING APPARATUS AND METHOD

BACKGROUND OF THE INVENTION

1. Field of the Invention

The present invention is in the technical field of vaporizing apparatus, and pertains more particularly to apparatus for converting concentrated wax and oils to vapor for ingestion by inhalation.

2. Description of Related Art

The process in *cannabis* related art, is a well-understood process for converting a lipid extract concentrate made from plant material, for example concentrated *cannabis* wax and oil, to vapor for inhalation. There is wide variety of commercially-available apparatus for supporting this process, mostly comprising tubular constructs or assemblies having an interface on one end for the user's mouth, and a tip on the other end capable of being heated to a relatively high temperature. The tip, once heated, is held near a quantity of concentrated wax or oil, usually held in a dish or other open receptacle, with the heated tip just touching the concentrate, but not completely immersing the heated tip. Vapor induced from the concentrate by the heat of tip, either in contact or by radiative transfer, is drawn by the user up through the tubular device and into the user's mouth, then lungs.

There are many variations in the art for materials, both for tips and tubes, and temperatures in use, and also for dimensions and geometry. The problems and challenges in the process, and hence for designers and purveyors of equipment, are also rather well-known. One such is that a relatively high temperature is necessary to accomplish sufficient vaporization, and the composition and temperature of the vapor drawn through a vaporizing apparatus is strongly dependent on the temperature of the burning tip, and the shape and other characteristics of the tip. It is also known that vapor characteristics are not constant, and vary over time of use, because a heated tip starts at one temperature, and may cool rapidly in use.

There are many components in a lipid concentrated product including flavonoids, cannabinoids, antioxidants and terpenes that must be considered when achieving the full effect of a vaporizing experience for a user. For example, in a lipid concentrate made from *cannabis* may contain quercetin b.p. 250° C., pulegone b.p. 224° C., tetrahydrocannabivarin (THCV) b.p. 220° C., cannabichromene (CBC) b.p. 220° C., α-terpineol b.p. 217-218° C., borneol b.p. 209° C., linalool b.p. 198° C., cannabinol (CBN) b.p. 185° C., cannflavin b.p. 182° C., apigenin b.p. 178° C., p-cymene b.p. 177° C., d-limonene 177° C., 1,8-cineole (eucalyptol) 176° C., Δ-8-tetrahydrocannabinol (Δ-8-THC) cannabinoid Resembles Δ-9-THC 175-178° C., Δ-3-carene 166-168° C., cannabidiol (CBD) 160-180° C., Δ-9-tetrahydrocannabinol (THC) cannabinoid b.p. 157° C., and α-pinene 156° C.

Although a high temperature may be preferred by many, a high temperature in most circumstances produces a hot vapor, that can be uncomfortable or even dangerous for the user. Additionally, when the temperature is too high, the flavonoids and terpenes cannot be detected by the user and any medicinal properties they may contain may be destroyed, depending on how high the temperature reaches. Further, care must be taken in placing the tip near the concentrate without immersion, and may also result in a user's face being exposed to hot vapor. Additionally, when the concentrate is heated and inhaled through a tubular apparatus much of the concentrate is caught in a down stem that the tip is attached to and the concentrate is then wasted. There are many substances such as flavonoids and terpenes in a concentrate that are destroyed or not detected by the inhaler when the vapor is at a temperature that is too high.

What is clearly needed is a vaporizing apparatus that provides a repeatable, comfortable experience, provides a vapor rich in the flavor ingredients, and is easy and safe to use.

BRIEF SUMMARY OF THE INVENTION

The present invention provides a lipid concentrate vaporizer apparatus including an elongate hollow tubular upper portion including an opening at one end, a lower portion including a bulbous closed second end, a solid stem extending away from the bulbous portion and a solid heating tip formed at the end of the stem. In this embodiment the upper and lower portions share a wall thickness and the bulbous end includes one or more air intake holes formed at a position above the stem and when the tip is heated to a temperature to vaporize and not combust the lipid concentrate contained in a vessel having a specific shape. The tip makes contact with the lipid concentrate after heating and the resulting vapor is drawn into the upper portion via the holes by a user creating suction and inhaling at the opening at the one end.

In one embodiment the vaporizer apparatus is manufactured from titanium, crystal, ceramic or tempered glass. Specifically, the glass is borosilicate glass. Additionally, the tip may be shaped to make contact with a shape formed by an inner surface of the vessel.

In another embodiment the stem is oriented perpendicular to the bulbous closed second end. In another embodiment the stem is formed at most at a forty five degree angle to the bulbous closed second end. In yet another embodiment the one or more vapor intake holes may have a diameter between 1 mm and 3 mm. The stem may have a height of 1-3 cm from the heating tip to the closed second end.

A method of vaporizing a lipid concentrate while inhaling it is provided comprising the steps of (a) providing a vessel of a specific shape containing a lipid concentrate; (b) heating a solid tip of a vaporizer apparatus to a temperature to vaporize and not combust the lipid concentrate, the tip formed at the end of a solid stem extending from a bulbous lower closed end of a hollow elongate tube having a second open end; (c) making contact between the heated tip and the lipid concentrate causing the lipid to vaporize; and (d) creating suction and inhaling, by a user at the second open end, forcing vapor from the lipid concentrate into one or more intake holes positioned above the stem in the bulbous lower closed end.

In one embodiment the vaporizer apparatus is manufactured from titanium, crystal, ceramic or tempered glass, specifically borosilicate glass. The tip may be shaped to make contact with a shape formed by an inner surface of the vessel.

In one embodiment the stem is oriented perpendicular to the bulbous closed second end, optionally, the tip may be formed at most at a forty five degree angle to the bulbous closed second end.

Another embodiment provides that the one or more vapor intake holes have a diameter between 1 mm and 3 mm. Also, the stem has may have a height of 1-3 cm from the heating tip to the lower closed end.

An additional modification of the vaporizing apparatus includes an elongate hollow tubular upper portion including an opening at one end, a lower elongate tubular portion having a second opening at a second end, a solid portion of the tube comprising less than half the circumference extending away from the second opening, thereby forming a stem and a solid heating tip formed at the end of the stem.

In this embodiment when the tip is heated to a temperature to vaporize and not combust the lipid concentrate contained in a vessel having a specific shape, the tip makes contact with the lipid concentrate and the resulting vapor is drawn into the upper portion via the second opening by a user creating suction and inhaling at the opening at the one end.

In additional embodiments, the vaporizer apparatus may be manufactured from titanium and the heating tip may have a diameter greater than the lower tubular portion. Additionally, the stem may have a height of 1-3 cm from the heating tip to the second opening.

DETAILED DESCRIPTION OF THE INVENTION

Figure 1:
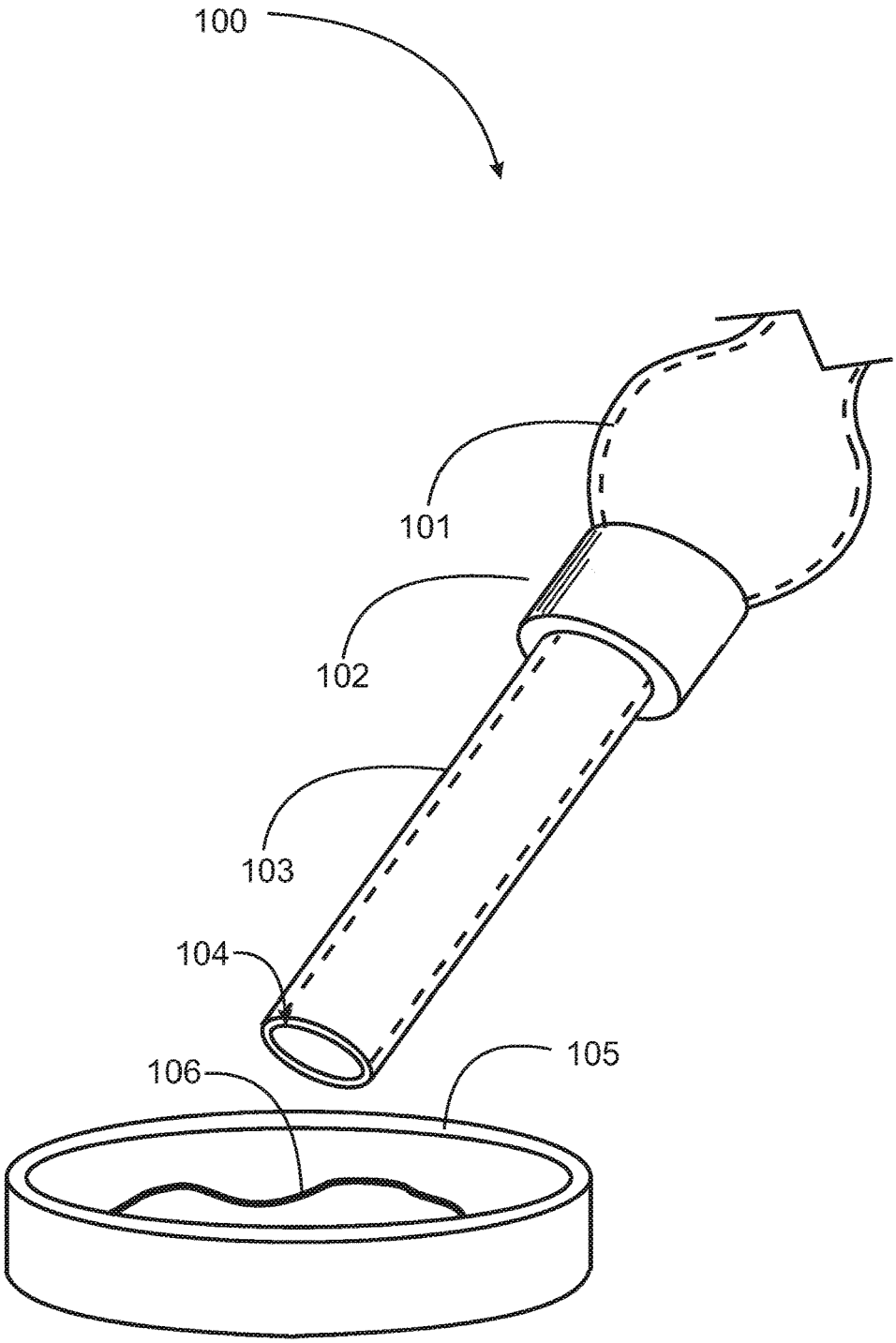
Fig. 1 (Prior Art)
FIG. 1 is a perspective view of a lower portion of a vaporizing apparatus in the prior art.

FIG. 1 is a perspective view of a vaporizing apparatus 100 in the conventional art at the time of filing the present application. An upper glass or crystal portion 101 is shown cut off, as the upper portion is not particularly germane to the present description. A lower end of the upper portion provides a metal threaded socket 102, for accepting a male-threaded tubular tip apparatus 103, ending in a circular opening at 104.

In use a user holds apparatus 100 in one hand, and wields a butane torch with the other hand, to heat tip 104 to a sufficient temperature for the vaporizing process. The heating operation is dependent on a number of variables, such as the material of the tip, often titanium, crystal or various types of glass, for example borosilicate glass. The wall thickness, the nature of the torch used, and the time of application, among other variables. Typically a user holds the flame of the torch on the tip until the tip glows with red radiation. The actual color sought is a matter of experiment and experience. The skilled person will understand as well, that the tip will begin to cool as soon as the torch is removed, and the rate of cooling has certain variables as well. The tip needs to be positioned to the concentrate right away, and the vapor produced and inhaled. Further, the skilled person will understand that the characteristics of the vapor will vary as the tip rapidly cools.

The design and use of the prior-art apparatus, as described above demonstrates some of the drawbacks and problems described in the background section above. For example, the problem of positioning the tip to the concentrate, and the temperature variations that occur.

Figure 2:
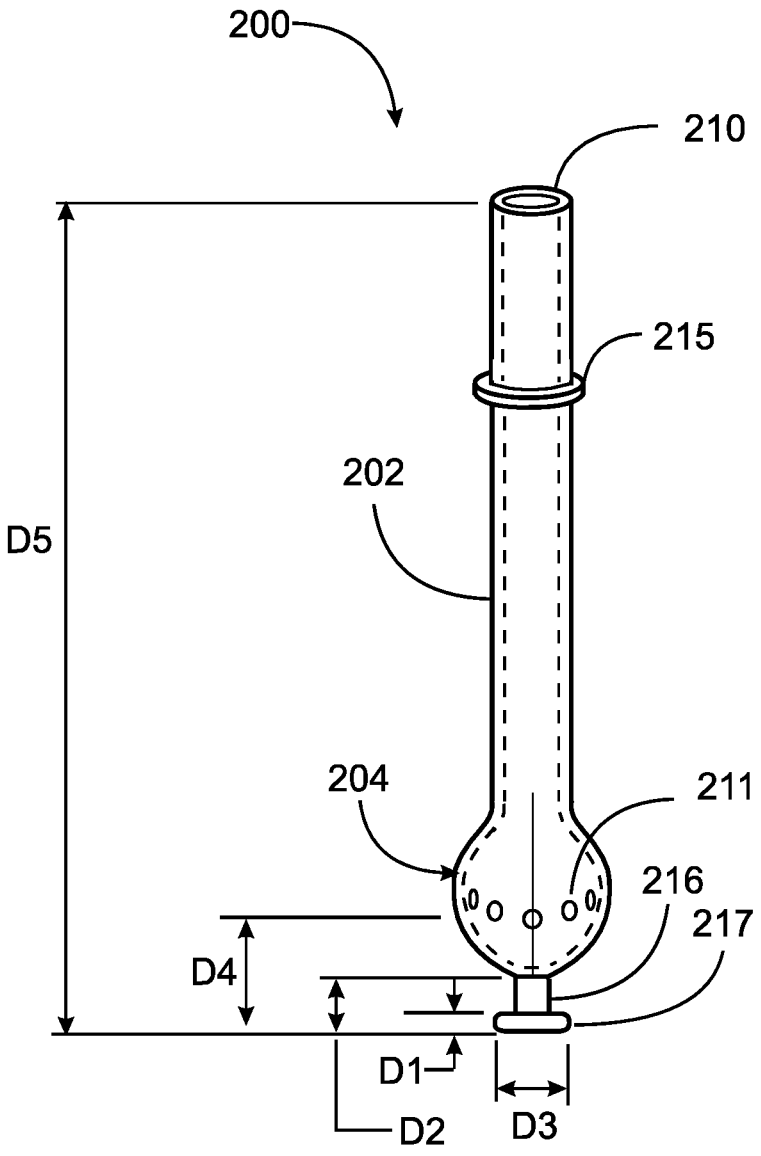
FIG. 2 is an elevation view of a vaporizing apparatus in one embodiment of the invention.

FIG. 2 is an elevation view of a vaporizing apparatus in one embodiment of the invention. In this embodiment, the apparatus is a contiguous piece of glass or crystal, both of which may be tempered, and are amenable to glass-blowing techniques.

In the embodiment illustrated in FIG. 2, vaporizer apparatus 200 has an essentially tubular upper portion 202 with an upper opening 210 for a user to draw upon in use. There is, in this embodiment, a ring 215 at some dimension from end 210, which may be used for gripping the device in use. A bulbous portion 204 may be formed at a lower region, and openings 211 may be formed, such as by drilling or piercing in the formation process. Alternatively, a straight profile may be implemented instead of the bulbous structure. Opening 211 may vary in number, position and diameter in different embodiments. The openings may range in diameter from 1-3 mm. A solid tip extension 216 is affixed at the lowermost extremity of portion 204, and this extends to a solid heating tip 217. The tip extension and tip may be formed by known techniques in glass blowing or a mold.

Overall height D5 of apparatus 200 may vary in different embodiments for several reasons. A greater overall height enable a user's face to be further from the hot tip and vaporizing action, and will result in a cooler ingestion, as the vapor will travel further in upper tube portion 202. A shorter overall height will accommodate users who prefer a hotter vapor action.

Dimensions D3, a diameter of tip 217, and height D1 of tip 217 provide the thermal mass for the tip in this embodiment. Larger dimensions result in increased mass, and therefore a larger thermal mass, capable of contributing more energy to vaporize concentrate. Dimension D2 influences the length of extension 216, and is important, along with the diameter of extension 216, as a barrier against conductive heat transfer from tip 217 to bulb 204. D4 is a nominal dimension from the bottom of tip 217 to a median height of openings 211. This median height may vary according to the size, number and pattern of openings 211. In some embodiments D2 may be as small as 1 cm., but will typically be more, up to a maximum of about 3 cm.

Figure 3:
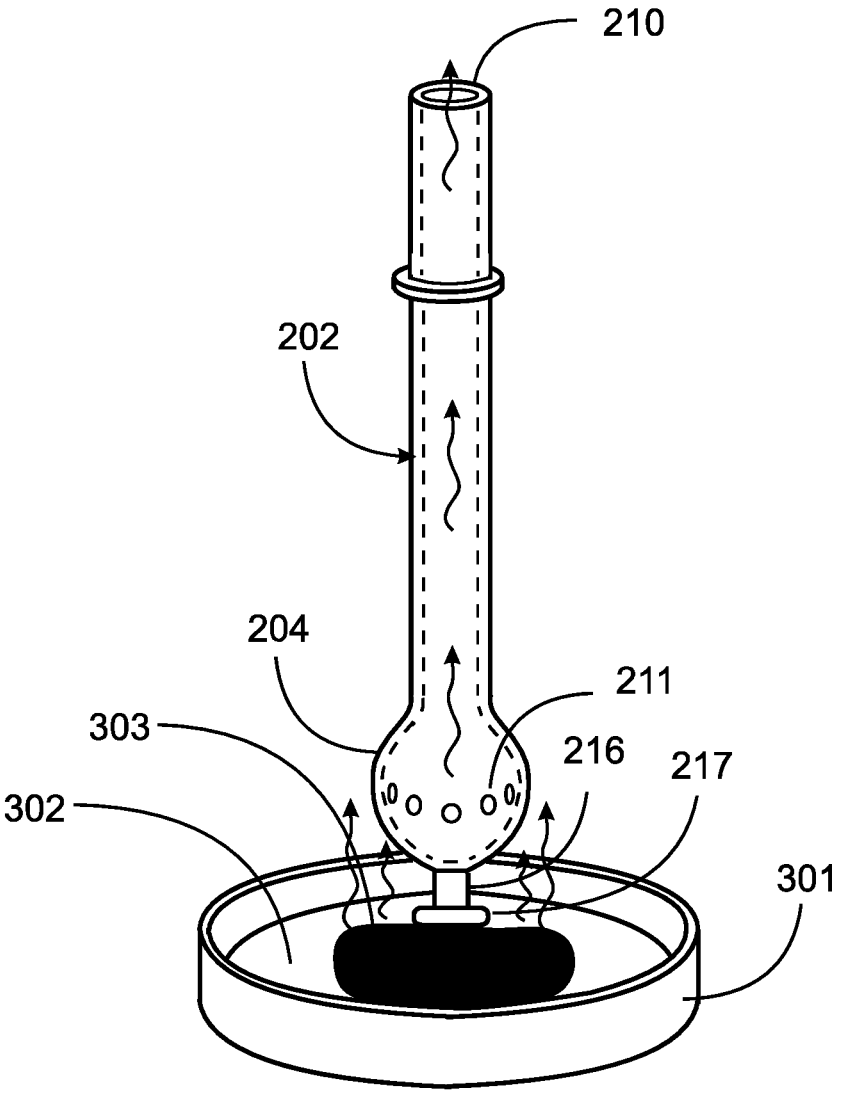
FIG. 3 is an elevation view of the apparatus of FIG. 1 in use, in an embodiment of the invention.

FIG. 3 is an elevation view of apparatus 200 of FIG. 2 in use, in an embodiment of the invention. The apparatus is shown with tip 217 inserted onto or into a quantity of lipid concentrate 303 of an oil or wax viscosity placed on bottom 302 of a container 301, in this case round. Although not show, the user has, prior to making contact between tip 217 and concentrate 303, heated tip 217 in a flame, or other very hot reaction, to a temperature both safe for the material, quartz, glass or ceramic in this example, and sufficient to produce a quantity of vapor from the concentrate. Note that in this specification the tip of a vaporizing apparatus is simply called a tip, and not denoted as a nail, as is common in the art, simply because nails in a broad sense are colloquially understood by the general public to be metal.

Tip temperature for a low temperature dab hit is between 175 and 205 degrees Celsius, and in this temperature range cannabinoids, flavonoids and terpenes will be vaporized effectively while plant materials or impurities that may be in your dabs will not be burned, thereby spoiling the flavor and taste of the vapor. Typically, tips are heated to a red glow as a first step, because it isn't possible to see a temperature or a glass or quartz tip at 400 degrees F. The red glow is at about 700-800 F, and an experimental time has to be worked out to allow the 370-425° C. F tip to cool to around 205° C.

Once the heating and cool time is mastered the tip is introduced to the concentrate, and vapor will be introduced for a period of time depending on the thermal mass of the tip. In a unique aspect of the inventive apparatus described here, the vapor produced rises above the concentrate, and is ingested into bulb 204 through openings 211, and thence up the cylindrical portion 202 to upper rim 210. Openings 211 may vary in size and quantity, for example two openings may be provided, or one larger opening may be provided. The amount of holes and size are important to keep the concentrate vapor from being extracted up into the tube during inhalation.

In one embodiment the openings 211 may restrict amount of air intake regulating (slowing) a rate of vapor intake during inhalation by a user. For example, two holes of 1 mm each would cause slower inhalation than 3 holes of the same size or two holes having 2 mm opening size. Users as known in the prior art using an apparatus as shown in FIG. 1 have no regulation when inhaling from tube 103 via tip 104.

In this embodiment, the distance (D4) from the tip 217 to openings 211 also allow the vapor to cool considerably prior to entering the tube 202. When vapor is inhaled at a cooler temperature the flavonoids and terpenes are tasted and smelled as intended.

The unique geometry of apparatus 200 in this embodiment provides advantages. Firstly, the user need not be extremely careful about placement of the tip relative to the concentrate. The vapor produced rises, and is ingested at openings 211 in any case. The entry points into bulb 204, being at a distance from the point of production of the vapor, also allow the vapor to be drawn in at a lower temperature than as first evaporated, so the user may use a higher temp at the tip, and still avoid excessively hot vapor at the top of the apparatus. Additionally, less concentrate is deposited on an inside surface (not shown) of the device 202 when the heating tip is not located at a same position as the vapor intake.

Figure 4:
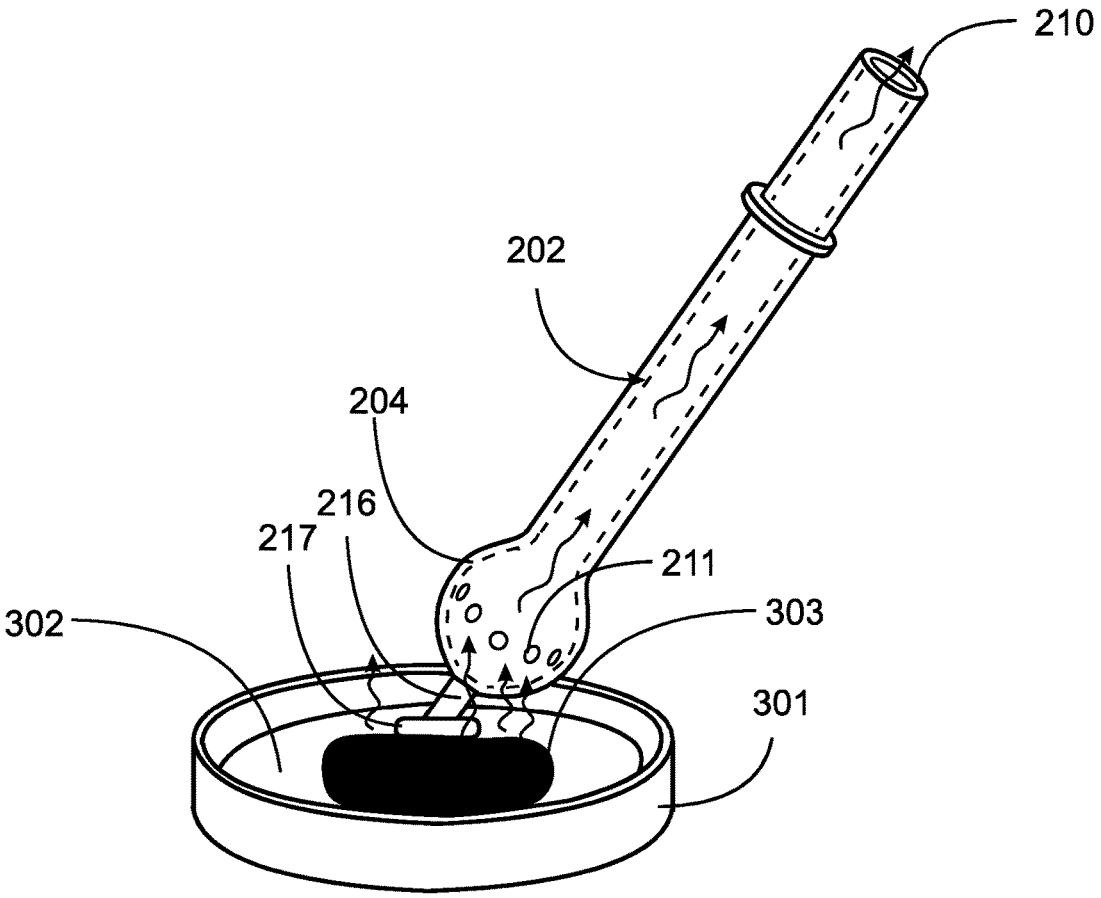
FIG. 4 is an elevation view of an alternative vaporizing apparatus in use according to an embodiment of the invention.

FIG. 4 is an elevation view of an alternative vaporizing apparatus in use according to an embodiment of the invention. The elements of the vaporizing apparatus in this embodiment are the same as in FIG. 3, except the orientation of dab tip 217 relative to tip extension 216 is changed, and is no longer orthogonal, as it is in the apparatus illustrated in FIG. 2. The dab tip 217, as seen in both FIG. 2 and in FIG. 4, is essentially a disk with rounded edges, the disk having a central plane. In the apparatus of FIG. 2, the central plane of the disk that is dab tip 217 is at a right angle to tip extension 216, and to the central axis of the vaporizer apparatus. In the alternative apparatus of FIG. 4, the central plane of dab tip 217 is at about a forty-five degree angle with the axis of the vaporizer apparatus and tip extension 216.

An advantage of the arrangement illustrated with reference to FIG. 4 is that the disk of the dab tip may be placed to the concentrate 303 with maximum surface area exposure, for most efficient heat transfer, while the angle of the vaporizer apparatus may be inclined, in this example, by forty-five degrees. Vapor produced still rises for a distance before being drawn into the apparatus through openings 211, which allows the vapor to cool, and the user's face is not directly over the point of process at the dab tip, but removed at an angle, which provides a more comfortable and safer experience.

In some embodiments, in the version with the dab tip angled to the axis of the apparatus, the number and location of ingesting openings 211 may also be altered. The length of tip extension 216 may be altered, as well, and the thickness and overall size and mass of dab tip 217 may vary as well.

Figure 5A:
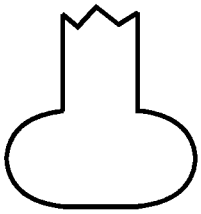
FIGS. 5A through 5H are schematic views of heating tips for vaporizing apparatus in various embodiment of the present invention.
Figure 5B:
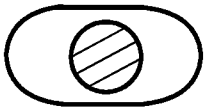
Figure 5C:
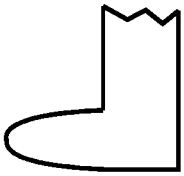
Figure 5D:
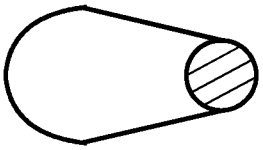
Figure 5E:
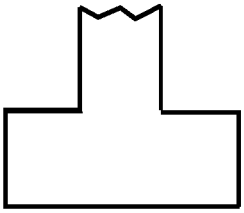
Figure 5F:
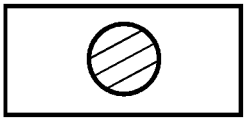
Figure 5G:
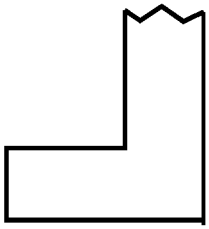
Figure 5H:
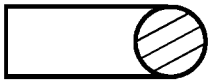

FIGS. 5A through 5H are elevation and associated plan views of dab tips for vaporizing apparatus in various embodiment of the present invention. The tip extension and dab tip used thus far as example in this specification have been described as a round extension ending in a disk-shaped tip with rounded edges. FIG. 5A shows an elevation view of a very similar tip, but not circular like a disk. The tip has rounded edges, but has a length greater than a width, as seen in plan view 5B. The dab tip in FIGS. 5C and 5D has a rounded edge, but extends from the tip extension to one side, and becomes wider with increased distance from the tip extension, to which it is joined. The dab tip in FIGS. 5E and 5F is a rectangular block, and the extension is centered on a surface of the block. The dimensions of the block may vary, and in alternative embodiments the extension may attach in different places on a surface of the block. The tip in FIGS. 5G and 5H are also rectangular, with a width the same as the diameter of the tip extension, and the rectangular tip extending just to one side of the tip extension. It will be apparent from the several figures and descriptions that tips, and relation to extensions, may be in a wide variety of geometries for a variety of purposes.

Figure 6:
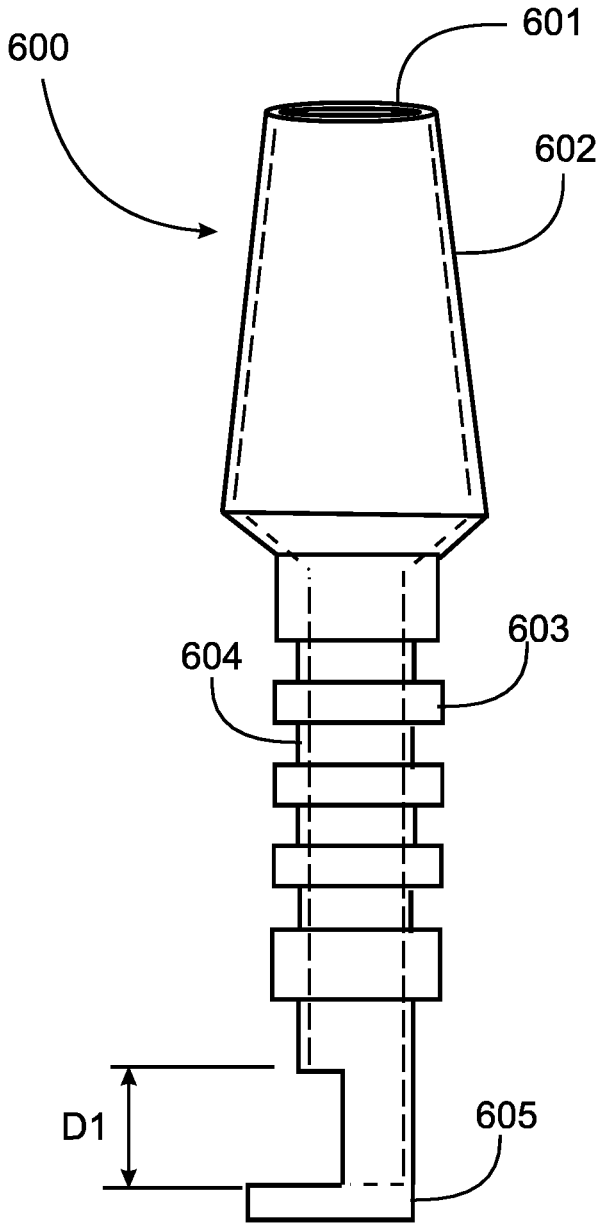
FIG. 6 is an elevation view of a vaporizing apparatus in yet another alternative embodiment of the invention.

FIG. 6 is an elevation view of a vaporizing apparatus 600 in yet another alternative embodiment of the invention. The apparatus in FIG. 6 is largely a metal apparatus machined from, ion this example stainless steel. Dab tip 605 is titanium, and integrally and contiguously extends from tube 604 or is fixed to the upper part of the apparatus by such as TIG welding, or by friction welding. In one embodiment a groove may be machined into tip 605, curved as the wall of tube 604 and of a width of the wall thickness of tube 604.

Additionally, by carefully controlling the dimensions of the wall of tube 604 and the width and curvature of the groove, tip 605 may be heated to a relatively high temperature, expanding the dimensions of the circular groove, tube 604 may be inserted in the groove, and upon cooling the two parts will be joined by compression. This is a method used for such as joining locomotive wheels to axels. Upon subsequent heating of tip 605, the tube will also be heated, so the compression joint will not be parted. Joint wax may also be implemented to attach 602 to an extension handle such as 903 of FIG. 9.

In the embodiment illustrated by FIG. 6, a section of tube 604 is cut away for a length D1. The depth of this cut may vary up to about one-half of the diameter of tube 604. The purpose and effect of this cut is that vapor produced by proximity of hot tip 605 will be drawn into tube 604 from the side up to the full height of D1, accomplishing an effect similar to that accomplished by the openings 211 into bulb 204 in the embodiment illustrated by FIG. 2. D1 will vary in different embodiments, as the height above the point of process where vaporization occurs, and may vary from about 1 cm. to about 3 cm., but in some embodiment may be more than 3 cm.

The tip 605 may take any of the shapes of FIG. 5, and a variety of other shapes as well. Section 602 provides for an expansion of vapor moving up the apparatus, which has a cooling effect.

Figure 7A:
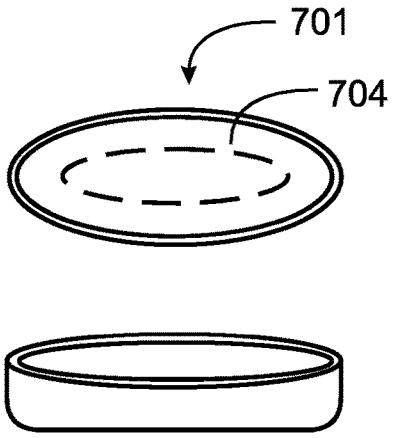
FIGS. 7A through 7C depict different shapes of containers for holding *cannabis* concentrate for use with vaporizers in embodiments of the present invention.

FIGS. 7A, B and C illustrate three different shapes of containers for holding concentrate to be vaporized by vaporizing apparatus in embodiments of the present invention. In each figure a plan view and a corresponding elevation view are shown. Container 701 in FIG. 7A is an oval-shaped container with side walls rounded at the bottom, so the container rests on a base represented by dotted line 704. In some embodiments a container like this one, with rounded bottom, may be circular rather than oval-shaped.

Figure 7B:
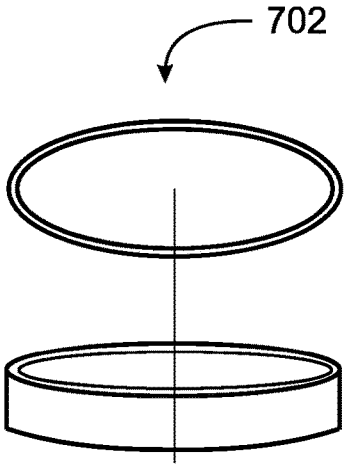
Figure 7C:
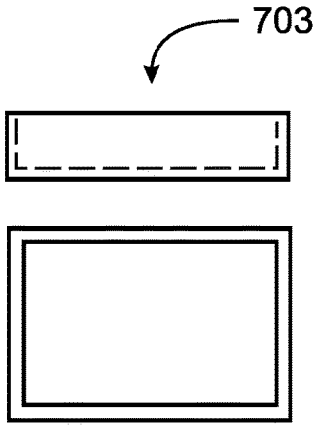

FIG. 7B illustrates a container 702, which is oval in shape, but the bottom of the container and the sidewalls matt at a sharp right angle. FIG. 7C illustrates a container that is rectangular in shape, and has straight sides, such that all four sides meet the bottom of the container at a sharp right angle. These figures illustrate a variety of container shapes, but certainly not all such shapes that might be encountered in practice.

It will be understood by the skilled artisan, that when vaporizing a concentrate wax or an oil from a container, using a heated dab tip, the concentrate will flow in the container to the edges and corners of the bottom of the container. In use of a conventional vaporizer apparatus like that shown in FIG. 1, a significant quantity of concentrate might be wasted, and will have to be cleaned from the container by, for example, cotton swabs, because the dab tip is not shaped to reach efficiently into the corners and edges of the container.

Figure 8A:
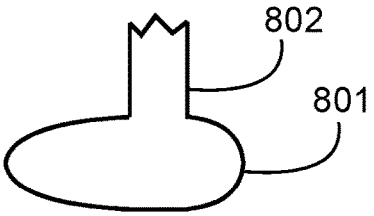
FIGS. 8A through 8F illustrate different shapes of tips for vaporizer apparatus shown in FIG. 6, in various embodiments of the present invention.
Figure 8B:
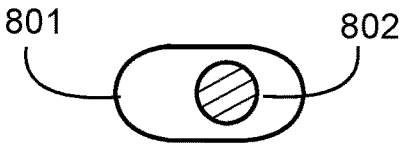

FIGS. 8A through 8F illustrate different shapes of tips for vaporizer apparatus shown in FIG. 6, in various embodiments of the present invention. In each case, an elevation view and a plan view are shown. FIG. 8A shows an elevation view and FIG. 8B shows a plan view for a tip 801 at an end of an extension 802, in which the tip extends somewhat more to one side of extension 802 than from the opposite side. Further, the tip is rounded both in vertical and horizontal section. This tip is useful for vaporizing from a container like container 701 of FIG. 7A, and the curvatures of the tip may be matched to the curvature of the mating of the sidewalls and the bottom of the container, such that any concentrate migrating anywhere in the container may be conveniently vaporized, leaving essentially no concentrate behind.

Figure 8C:
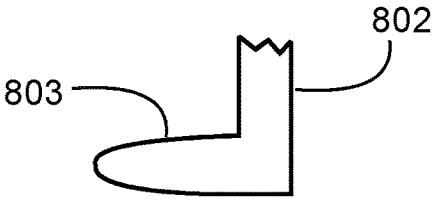
Figure 8D:
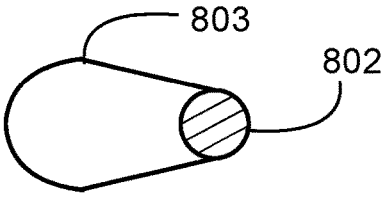

FIGS. 8C and 8D show a tip 803 also with curved surfaces and a spread in width, that may be useful for containers that have a somewhat sharper radius where sidewalls meet the bottom, and the extra width may provide an increase in thermal mass for increased time of use before the tip is too cool to be effective.

Figure 8E:
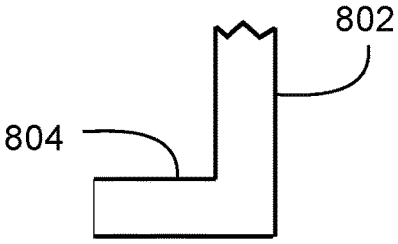
Figure 8F:
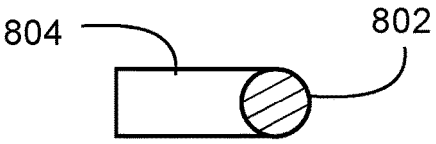

FIG. 8E illustrates a tip 804 with rectangular configuration, such that there are sharp edges at ninety degrees, that will enable intimate proximity to edges and corners of a container like container 703 of FIG. 7C. FIG. 8F shows a plan view of FIG. 8E.

From the example given, the skilled person will understand that dab tips may be designed and implemented in conjunction with container geometry, to maximize effective use and conversion of concentrate to vapor.

Figure 9:
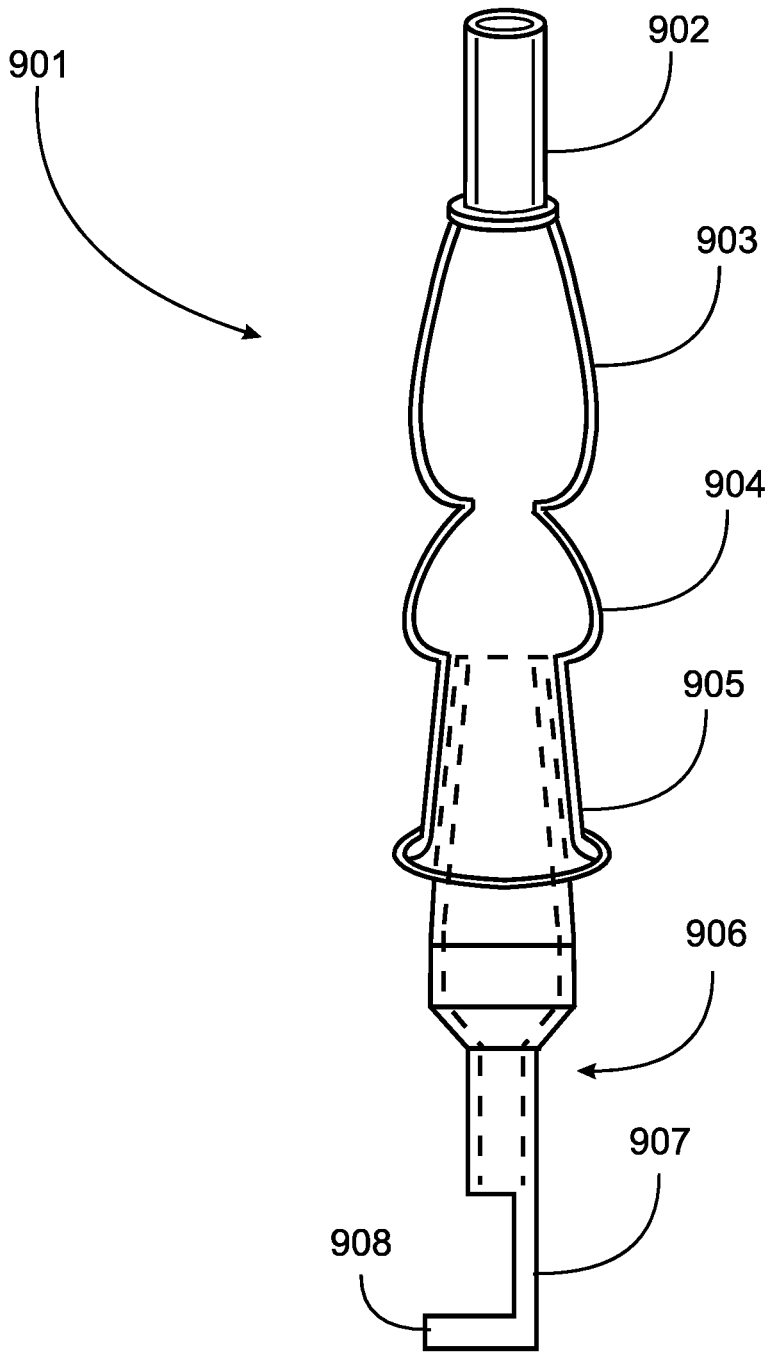
FIG. 9 is an elevation view of an apparatus in yet another alternative embodiment of the present invention.

FIG. 9 is an elevation view of an apparatus 901 in yet another alternative embodiment of the present invention. An upper portion of this apparatus comprises a drawing tube 902 at the upper most extremity, two expansion chambers 903 and 904, and a mating region 905 tapered on the inside. The upper portion in this implementation is made from glass or crystal.

A lower portion 906 has a tip extension 907, ending at a dab tip 908. The lower portion, in this implementation, is made of titanium, including tip 908, but in some embodiments may be a different metal, like, for example, stainless steel, and tip 908 may be titanium, and may be joined to extension 907 by any one of a variety of techniques. In this embodiment, a portion of the hollow tip extension 907 is cut away as shown at region 909, in much the manner described above in the apparatus illustrated in FIG. 6. This feature allows for vapor to be created by proximity of hot dab tip 908, which vapor may then rise for a distance before being drawn in the hollow tip extension.

Figure 10A:
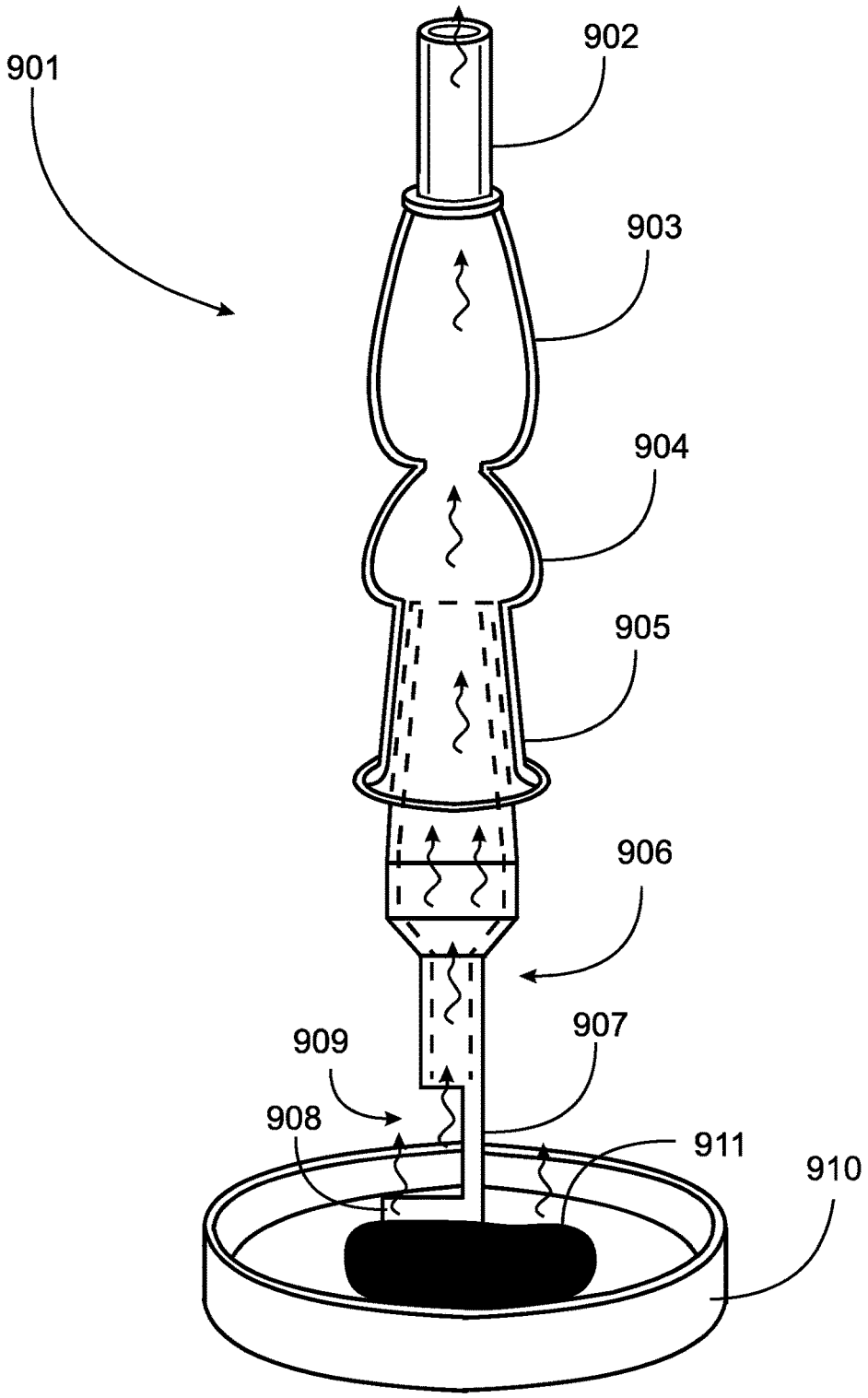
FIG. 10A is an elevation view of the apparatus of FIG. 9 in use in an embodiment of the present invention.
Figure 10B:
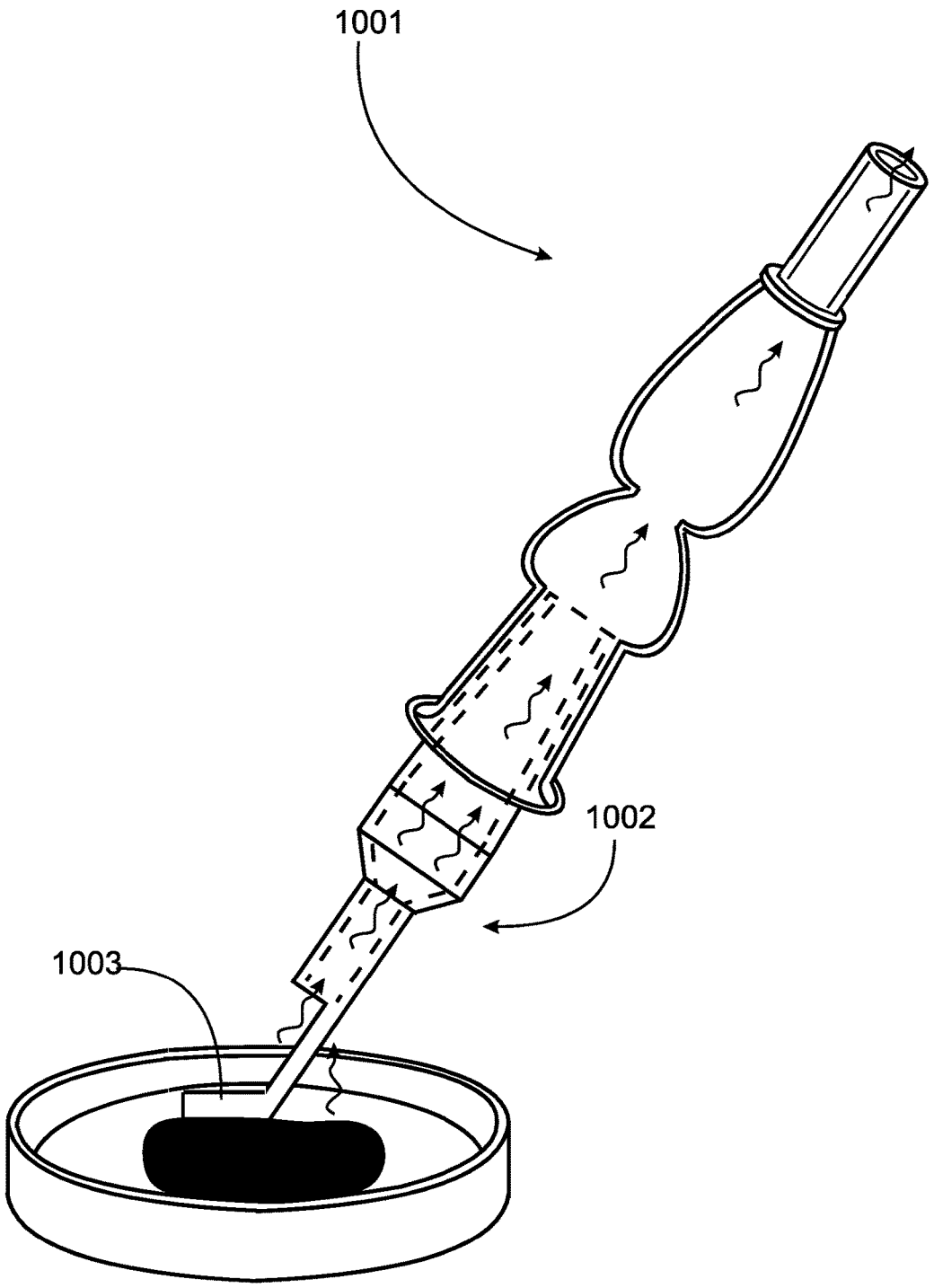
FIG. 10B is an elevation view of an apparatus similar to the apparatus of FIG. 10A in an alternative embodiment of the invention.

FIG. 10A illustrates apparatus 901 in use, with dab tip 908 proximate concentrate 911 in container 910, with vapor shown being drawn into and up through the apparatus. FIG. 10B illustrates a similar apparatus to that of FIG. 9 in use. In FIG. 10B apparatus 1001 is very much the same as apparatus 901, especially in the upper portion, but has a lower portion 1002 wherein the dab tip 1003 is set at an angle to be able to lie horizontal with the main axis of the apparatus at angle as shown.

FIG. 10B illustrates an apparatus 1001 having a an upper portion of glass or crystal, essentially the same as the upper portion of apparatus 901 of FIGS. 9 and 10A. Apparatus 1001 differs in that the metal lower portion 1002 has a dab tip 1003 that is angled with the axis of the apparatus, such that a user's face may be further removed from the point-of-process.

Figure 11:
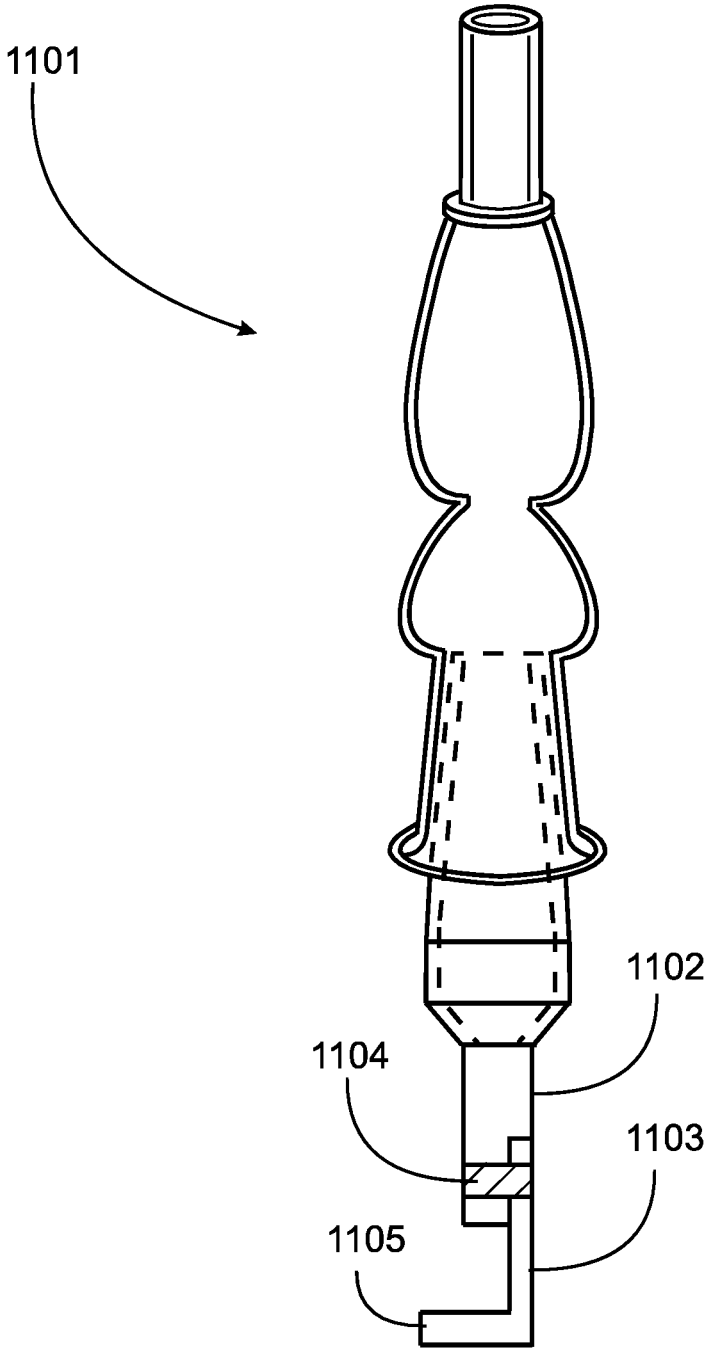
FIG. 11 is an elevation view of an apparatus in yet another alternative embodiment of the invention.

FIG. 11 is an elevation view of a vaporizing apparatus 1101 in yet another aspect of the present invention. The apparatus of FIG. 11 has an upper portion essentially the same as apparatus 9, 10A and 10B, except that the metal lower portion is now in two parts, 1102 and 1103. Part 1102 fits into the receptacle of the upper glass or crystal portion, and has a stepped lower region. Part 1103 comprises a tip extension and a dab tip 1105. Parts 1102 and 1103 are joined by a binder strip 1104. Binder strip 1104 may be manufactured from silicone or another material capable of withstanding high temperatures incurred as a result of heating tip 1105. This assembly allows for removing and replacing dab tips of different geometry and configuration.

Figure 12:
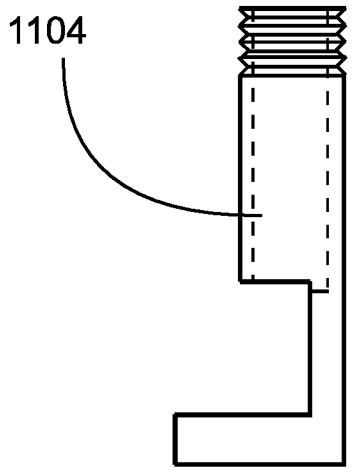
FIG. 12 is an elevation view of a portion, including a tip, of an apparatus in an embodiment of the invention.

In another embodiment portions 1102 and 1103 of FIG. 11 may be a single contiguous element having a male thread at an upper end, shown as part 1201 in FIG. 12. In this embodiment part 1201 joins the metal lower part of the apparatus by threading into a female threaded opening of the lower metal element. This embodiment provides another way to accomplish replaceable dab tips for an apparatus.

Figure 13:
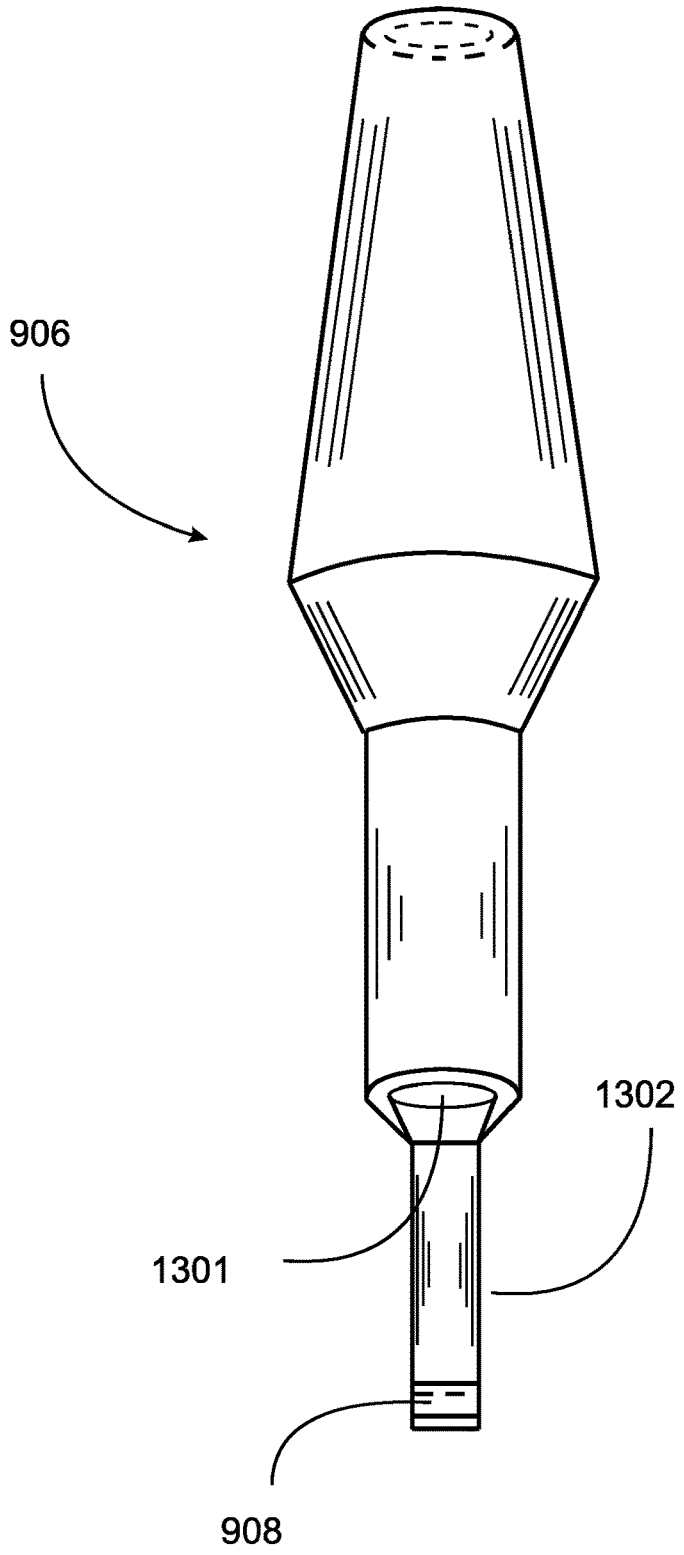
FIG. 13 is a front view of the apparatus shown in side view in FIG. 8.

FIG. 13 is a view of lower metal portion 906 of apparatus 901 of FIG. 9, rotated by ninety degrees around the vertical axis, provided to show that there is an opening 1301 which admits vapor produced by dab tip 908, and that tip extension 1302 is rounded.

The skilled person will recognize that the embodiments described herein, illustrated in the figures, are merely examples of apparatus and elements that are within the breadth of the present invention. There are many alterations in geometry, size, and materials that will be within the scope of the broader invention. The invention is limited only by the claims that follow,

The invention claimed is:

1. A lipid concentrate vaporizer apparatus comprising;

an elongate hollow tubular upper portion including an opening at one end;

a lower portion including a bulbous closed second end;

a solid stem extending away from the bulbous portion; and a solid heating tip formed at a proximal end of the stem;

wherein the upper and lower portions share a wall thickness and the bulbous end includes one or more air intake holes formed at a position above the stem and when the tip is heated to a temperature to vaporize and not combust the lipid concentrate contained in a vessel, the tip makes contact with a lipid concentrate and the resulting vapor is drawn into the upper portion via the holes by a user creating suction and inhaling at the opening at the one end.

2. The vaporizer apparatus of claim 1 manufactured from titanium, crystal, ceramic or tempered glass.

3. The vaporizer of claim 2 wherein the glass is borosilicate glass.

4. The vaporizer of claim 1 wherein the tip is shaped to make contact with a shape formed by an inner surface of the vessel.

5. The vaporizer of claim 1 wherein the stem is oriented perpendicular to the bulbous closed second end.

6. The vaporizer of claim 1 wherein the stem is formed at most at a forty five degree angle to the bulbous closed second end.

7. The vaporizer apparatus of claim 1, wherein the one or more vapor intake holes have a diameter between 1 mm and 3 mm.

8. The vaporizer apparatus of claim 1, wherein the stem has a height of 1-3 cm from the heating tip to the closed second end.

9. A method for vaporizing and inhaling a lipid concentrate comprising the steps of:

(a) providing a vessel of a specific shape containing a lipid concentrate;

(b) heating a solid tip of a vaporizer apparatus to a temperature to vaporize and not combust the lipid concentrate, the tip formed at the end of a solid stem extending from a bulbous lower closed end of a hollow elongate tube having a second open end;

(c) making contact between the heated tip and the lipid concentrate causing the lipid to vaporize; and (d) creating suction and inhaling, by a user at the second open end, forcing vapor from the lipid concentrate into one or more intake holes positioned above the stem in the bulbous lower closed end.

10. The method of claim 9 wherein the vaporizer apparatus is manufactured from titanium, crystal, ceramic or tempered glass.

11. The method of claim 10 wherein the glass is borosilicate glass.

12. The method of claim 9 wherein the tip is shaped to make contact with a shape formed by an inner surface of the vessel.

13. The method of claim 9 wherein the stem is oriented perpendicular to the bulbous closed second end.

14. The method of claim 9 wherein the stem is formed at most at a forty five degree angle to the bulbous closed second end.

15. The method of claim 9 wherein the one or more vapor intake holes have a diameter between 1 mm and 3 mm.

16. The method of claim 9 wherein the stem has a height of 1-3 cm from the heating tip to the lower closed end.

17. A lipid concentrate vaporizer apparatus comprising;

an elongate hollow tubular upper portion including an opening at one end;

a lower elongate tubular portion having a second opening at a second end;

a solid portion of a tube comprising less than half the circumference extending away from the second opening, thereby forming a stem; and a solid heating tip formed at a proximal end of the stem;

wherein the when the tip is heated to a temperature to vaporize and not combust a lipid concentrate contained in a vessel having a specific shape, the tip makes contact with the lipid concentrate and the resulting vapor is drawn into the upper portion via the second opening by a user creating suction and inhaling at the opening at the one end.

18. The vaporizer apparatus of claim 17, manufactured from titanium.

19. The vaporizer apparatus of claim 17, wherein the heating tip has a diameter greater than the lower tubular portion.

20. The vaporizer apparatus of claim 17, wherein the stem has a height of 1-3 cm from the heating tip to the second opening.

* * * * *